US012270142B2

(12) United States Patent
Zattin et al.

(10) Patent No.: US 12,270,142 B2
(45) Date of Patent: Apr. 8, 2025

(54) LAUNDRY TREATMENT APPLIANCE WITH WATER SOFTENING SYSTEM

(71) Applicant: Electrolux Appliances Aktiebolag, Stockholm (SE)

(72) Inventors: Andrea Zattin, Solesino (IT); Martino Bondi, Sesto Al Reghena (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 47 days.

(21) Appl. No.: 17/712,645

(22) Filed: Apr. 4, 2022

(65) Prior Publication Data

US 2022/0333287 A1 Oct. 20, 2022

(30) Foreign Application Priority Data

Apr. 15, 2021 (EP) ..... 21168663

(51) Int. Cl.
*D06F 39/00* (2024.01)
*D06F 34/22* (2020.01)
(Continued)

(52) U.S. Cl.
CPC ..... *D06F 39/007* (2013.01); *D06F 34/22* (2020.02); *D06F 39/02* (2013.01);
(Continued)

(58) Field of Classification Search
CPC ..... D06F 34/22; D06F 39/007; D06F 39/02; D06F 39/022; D06F 39/088;
(Continued)

(56) References Cited

U.S. PATENT DOCUMENTS

2005/0252533 A1* 11/2005 Baeck ..... D06F 39/007 68/18 F
2005/0252538 A1* 11/2005 Vernon ..... B82Y 30/00 68/13 A
(Continued)

FOREIGN PATENT DOCUMENTS

CN 110331558 A 10/2019
EP 2486180 A1 8/2012
(Continued)

OTHER PUBLICATIONS

Non Final Office Action for U.S. Appl. No. 17/712,652, mailed Aug. 3, 2023, 14 pages.
(Continued)

*Primary Examiner* — Joseph L. Perrin
(74) *Attorney, Agent, or Firm* — Bradley Arant Boult Cummings LLP

(57) ABSTRACT

A laundry treatment appliance having a laundry treatment chamber adapted to receive laundry to be treated, a treatment agent delivery system configured to store an amount of treatment agent sufficient for performing a plurality of treatment cycles, and to deliver a treatment agent dose towards the laundry treatment chamber, the treatment agent dose being a fraction of the stored amount of treatment agent, a water supply unit configured to supply fresh water having a first level of hardness to the laundry treatment appliance, and a water softening system configured to selectively receive the fresh water from the water supply unit and to selectively provide softened water having a second level of hardness lower than the first level of hardness to said treatment agent delivery system.

22 Claims, 4 Drawing Sheets

(51) Int. Cl.

| | |
|---|---|
| ***D06F 39/02*** | (2006.01) |
| *D06F 101/20* | (2020.01) |
| *D06F 103/20* | (2020.01) |
| *D06F 105/02* | (2020.01) |
| *D06F 105/52* | (2020.01) |

(52) U.S. Cl.
CPC ..... *D06F 2101/20* (2020.02); *D06F 2103/20* (2020.02); *D06F 2105/02* (2020.02); *D06F 2105/52* (2020.02)

(58) Field of Classification Search
CPC ..... D06F 2101/20; D06F 2103/20; D06F 2105/02; D06F 2105/42; D06F 2105/52
See application file for complete search history.

(56) References Cited

U.S. PATENT DOCUMENTS

| | | | | |
|---|---|---|---|---|
| 2007/0000292 | A1* | 1/2007 | Park | D06F 39/007 68/13 A |
| 2008/0271500 | A1 | 11/2008 | Ahn | |
| 2010/0287709 | A1 | 11/2010 | Doyle et al. | |
| 2016/0326678 | A1* | 11/2016 | Stabon | D06F 34/28 |
| 2016/0326681 | A1 | 11/2016 | Stabon et al. | |
| 2017/0350060 | A1 | 12/2017 | Favaro et al. | |

FOREIGN PATENT DOCUMENTS

| | | | | |
|---|---|---|---|---|
| EP | 2565319 | A1 | 3/2013 | |
| EP | 3228741 | A1 * | 10/2017 | D06F 39/007 |
| EP | 3293302 | A1 | 3/2018 | |
| EP | 2486180 | B1 * | 6/2018 | D06F 39/005 |
| EP | 3617379 | A1 | 3/2020 | |
| IT | 201900007668 | A1 | 11/2020 | |
| KR | 20060036754 | A | 5/2006 | |
| KR | 20140126896 | A | 11/2014 | |
| WO | 2011042341 | A1 | 4/2011 | |
| WO | 2011094852 | A1 | 8/2011 | |
| WO | 2016062349 | A1 | 4/2016 | |
| WO | 2016101994 | A1 | 6/2016 | |
| WO | 2020006951 | A1 | 1/2020 | |

OTHER PUBLICATIONS

Extended European Search Report for European Application No. 21168663.9, dated Sep. 22, 2021, 10 pages.
Extended European Search Report for European Application No. 21168672.0, dated Sep. 24, 2021, 9 pages.
European Patent Office, European Application No. 21168663.9, "Communication Pursuant to Article 94(3) EPC," Sep. 9, 2024, 37 pages.

* cited by examiner

LAUNDRY TREATMENT APPLIANCE WITH WATER SOFTENING SYSTEM

This application claims priority to European Patent Application No. EP 21168663.9, filed Apr. 15, 2021, which is incorporated herein by reference.

FIELD OF THE INVENTION

The present invention generally relates to the field of laundry treatment appliances (hereinafter, concisely, "laundry appliances"), and particularly to laundry appliances for treating, e.g. washing, laundry, such as laundry washing appliances and laundry washing appliances also implementing laundry drying functions (also referred to as washers/dryers).

BACKGROUND OF THE INVENTION

A conventional laundry appliance is configured to treat laundry located in a (e.g., rotatable) drum by providing process liquids in a washing tub housing the rotatable drum.

Process liquids may comprise, e.g. depending on a selected treatment cycle and/or on a current phase of the selected treatment cycle, plain water or a treatment mixture comprising water mixed with proper treatment agents, including, but not limited to, washing detergents, rinsing detergents, bleaches and softeners detergents, softeners, bleaches, dyes.

A laundry appliance typically comprises a drawer having drawer compartments for containing one or more of such treatment agents.

In an increasingly common type of laundry appliance, the drawer implements or is part of a treatment agent delivery system, and comprises one or more compartments (hereinafter referred to as multi-dose compartments) each one adapted to contain multiple doses of a respective treatment agent for performing multiple washing cycles: just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliances, the laundry appliance may implement an auto-dosing functionality in which, at each washing cycle (and when the auto-dosing functionality is activated), a predetermined amount of treatment agent (usually referred to as treatment agent dose) is automatically taken from the multi-dose compartment(s) (e.g., by means of one or more pump devices of the treatment agent delivery system) and dispensed (e.g., through dedicated channels of the treatment agent delivery system) to a treatment chamber (such as a washing tub).

SUMMARY OF INVENTION

The Applicant has realized that the common laundry appliances implementing the auto-dosing functionality are not satisfactory because the hardness of the water (i.e. the amount of minerals, largely calcium and magnesium, dissolved in the water) may negatively affect the performance of a laundry appliance featuring the auto-dosing functionality.

Indeed, components or parts of the treatment agent delivery system that are in direct contact with hard or excessively hard water may become encrusted with limestone, thereby prematurely impairing the correct operation of the auto-dosing functionality.

The above issues are exacerbated by the fact that the hardness of water may significantly differ over different geographical areas, over different regions, over different cities, or over different areas of a same cities, or can even change over time in a same area. This makes even more difficult for the user the setting up of the correct treatment agent dose with regard to water hardness, as well as for the manufacturer of the laundry appliance to reliably determine an expected lifetime of the treatment agent delivery system, and hence to program in advance maintenance operations.

In view of the above, the Applicant has devised laundry appliance featuring the auto-dosing functionality that is not affected by the above-mentioned drawbacks.

Particularly, an aspect of the present invention relates to a laundry treatment appliance. The laundry treatment appliance may comprise a laundry treatment chamber adapted to receive laundry to be treated. The laundry treatment appliance may comprise a treatment agent delivery system configured to store an amount of treatment agent sufficient for performing a plurality of treatment cycles, and to deliver a treatment agent dose towards the laundry treatment chamber; the treatment agent dose is or comprises a fraction of the stored amount of treatment agent. The laundry treatment appliance may comprise a water supply unit configured to supply fresh water having a first level of hardness to the laundry treatment appliance. The laundry treatment appliance may comprise a water softening system configured to selectively receive the fresh water from the water supply unit and to selectively provide softened water having a second level of hardness lower than the first level of hardness to said treatment agent delivery system.

According to an embodiment, whose features are additional or alternative to any features of the previous embodiments, the treatment agent delivery system and the water softening system are arranged separate from each other.

According to an embodiment, whose features are additional or alternative to any features of the previous embodiments, the water softening system comprises a water tank configured to store the softened water. The water softening system may be configured to supply the softened water contained in said water tank to said treatment agent delivery system.

According to an embodiment, whose features are additional or alternative to any features of the previous embodiments, said water softening system comprises a water softening agent container configured to store a water softening agent capable of reducing hardness of water. Said water tank may have an input configured to be selectively in fluid communication with an output of said water softening agent container, and an output in fluid communication with said treatment agent delivery system.

According to an embodiment, whose features are additional or alternative to any features of the previous embodiments, the laundry treatment appliance comprises a control unit configured to activate/deactivate the water softening system to, respectively, allow/prevent the supply of the softened water from the water softening system to the treatment agent delivery system.

According to an embodiment, whose features are additional or alternative to any features of the previous embodiments, the laundry treatment appliance comprises a control unit configured to activate/deactivate the water softening system to, respectively, allow/prevent the supply of the softened water from the water tank to the treatment agent delivery system.

According to an embodiment, whose features are additional or alternative to any features of the previous embodiments, during an ongoing treatment cycle, the control unit is configured to activate/deactivate the water softening system depending on a current phase of the ongoing treatment cycle.

According to an embodiment, whose features are additional or alternative to any features of the previous embodiments, the control unit is configured to activate the water softening system when the laundry treatment appliance is switched on.

According to an embodiment, whose features are additional or alternative to any features of the previous embodiments, the control unit is configured to activate the water softening system if no regeneration of the water softening system is required, and to deactivate the water softening system if regeneration of the water softening system is required.

According to an embodiment, whose features are additional or alternative to any features of the previous embodiments, the control unit is configured to operate the water supply unit in a first or second operating mode allowing the supply of the fresh water from the water supply unit to the treatment agent delivery system or to the water softening system, respectively. The control unit may be configured to:

operate the water supply unit in the first operating mode when the water softening system is deactivated, so that the treatment agent delivery system delivers to the laundry treatment chamber a treatment mixture including the treatment agent dose mixed with the fresh water, or operate the water supply unit in the second operating mode when the water softening system is activated, so that the water softening system provides the softened water to the treatment agent delivery system and the treatment agent delivery system delivers to the laundry treatment chamber a treatment mixture including the treatment agent dose mixed with the softened water.

According to an embodiment, whose features are additional or alternative to any features of the previous embodiments, the control unit is configured to activate the water softening system on the basis of a treatment cycle selected by the user.

According to an embodiment, whose features are additional or alternative to any features of the previous embodiments, the laundry treatment appliance further comprises a water hardness sensing unit for sensing at least one between the first level of hardness and the second level of hardness.

According to an embodiment, whose features are additional or alternative to any features of the previous embodiments, the laundry treatment appliance further comprises a water hardness sensing unit for sensing the first level of hardness. The water softening system may be configured to adjust the second level of hardness based on the sensed first level of hardness.

According to an embodiment, whose features are additional or alternative to any features of the previous embodiments, the water tank of the water softening system is configured to store unused softened water resulting from a previous treatment cycle. The control unit may be configured to activate the water softening system based on an availability of the unused softened water being stored in the water softening system.

According to an embodiment, whose features are additional or alternative to any features of the previous embodiments, the control unit is configured to determine a first treatment agent dose if the water softening system is activated, or a second treatment agent dose if the water softening system is deactivated.

According to an embodiment, whose features are additional or alternative to any features of the previous embodiments, said first treatment agent dose is different from said second treatment agent dose.

According to an embodiment, whose features are additional or alternative to any features of the previous embodiments, said first treatment agent dose is lower than said second treatment agent dose.

According to an embodiment, whose features are additional or alternative to any features of the previous embodiments, said first treatment agent dose is determined based on at least one among:

the second level of hardness;

one or more laundry parameters among an amount of the laundry load, a type of the laundry load, and a degree of soiling of the laundry load;

one or more treatment cycle parameters;

one or more treatment agent parameters.

Another aspect of the present invention relates to a method of operating a laundry treatment appliance. The laundry treatment appliance may comprise a laundry treatment chamber adapted to receive laundry to be treated, and a treatment agent delivery system configured to store an amount of treatment agent sufficient for performing a plurality of treatment cycles and to deliver a treatment agent dose towards the laundry treatment chamber, wherein the treatment agent dose is a fraction of the stored amount of treatment agent. The method may comprise controlling a water softening system to selectively receive fresh water having a first level of hardness from a water supply unit and to selectively provide softened water having a second level of hardness lower than the first level of hardness to said treatment agent delivery system.

According to an embodiment, whose features are additional or alternative to any features of the previous embodiments, controlling the water softening system comprises activating or deactivating the water softening system to, respectively, allow or prevent the supply of the softened water from the water softening system to the treatment agent delivery system.

According to an embodiment, whose features are additional or alternative to any features of the previous embodiments, controlling the water softening system comprises activating or deactivating the water softening system depending on a current phase of an ongoing treatment cycle.

According to an embodiment, whose features are additional or alternative to any features of the previous embodiments, controlling the water softening system comprises activating the water softening system when the laundry treatment appliance is switched on.

According to an embodiment, whose features are additional or alternative to any features of the previous embodiments, controlling the water softening system comprises activating the water softening system if no regeneration of the water softening system is required, and deactivating the water softening system if regeneration of the water softening system is required.

According to an embodiment, whose features are additional or alternative to any features of the previous embodiments, the method further comprises:

operating the water supply unit in a first operating mode allowing the supply of the fresh water from the water supply unit to the treatment agent delivery system when the water softening system is deactivated, so that the treatment agent delivery system delivers to the laundry treatment chamber a treatment mixture including the treatment agent dose mixed with the fresh water, or operating the water supply unit in a second operating mode allowing the supply of the fresh water from the water supply unit to the water softening system when the water softening system is activated, so that the water softening system provides the softened water to the treatment agent delivery system and the treatment agent delivery system delivers to the laundry treatment chamber a treatment mixture including the treatment agent dose mixed with the softened water.

According to an embodiment, whose features are additional or alternative to any features of the previous embodiments, controlling the water softening system comprises activating or deactivating the water softening system on the basis of a treatment cycle selected by the user.

According to an embodiment, whose features are additional or alternative to any features of the previous embodiments, the water softening system comprises a water tank configured to store unused softened water resulting from a previous treatment cycle. Said controlling the water softening system may comprise activating the water softening system based on an availability of the unused softened water being stored in the water softening system.

According to an embodiment, whose features are additional or alternative to any features of the previous embodiments, the method comprises causing the treatment agent delivery system to determine a first treatment agent dose if the water softening system is activated, or a second treatment agent dose if the water softening system is deactivated.

According to an embodiment, whose features are additional or alternative to any features of the previous embodiments, said first treatment agent dose is different from said second treatment agent dose.

According to an embodiment, whose features are additional or alternative to any features of the previous embodiments, said first treatment agent dose is lower than said second treatment agent dose.

According to an embodiment, whose features are additional or alternative to any features of the previous embodiments, said first treatment agent dose is determined based on at least one among:

the second level of hardness;

one or more laundry parameters among an amount of the laundry load, a type of the laundry load, and a degree of soiling of the laundry load;

one or more treatment cycle parameters;

one or more treatment agent parameters.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read referring to the attached drawings, wherein.

DETAILED DESCRIPTION OF PREFERRED EMBODIMENTS OF THE PRESENT INVENTION

Figure 1A:
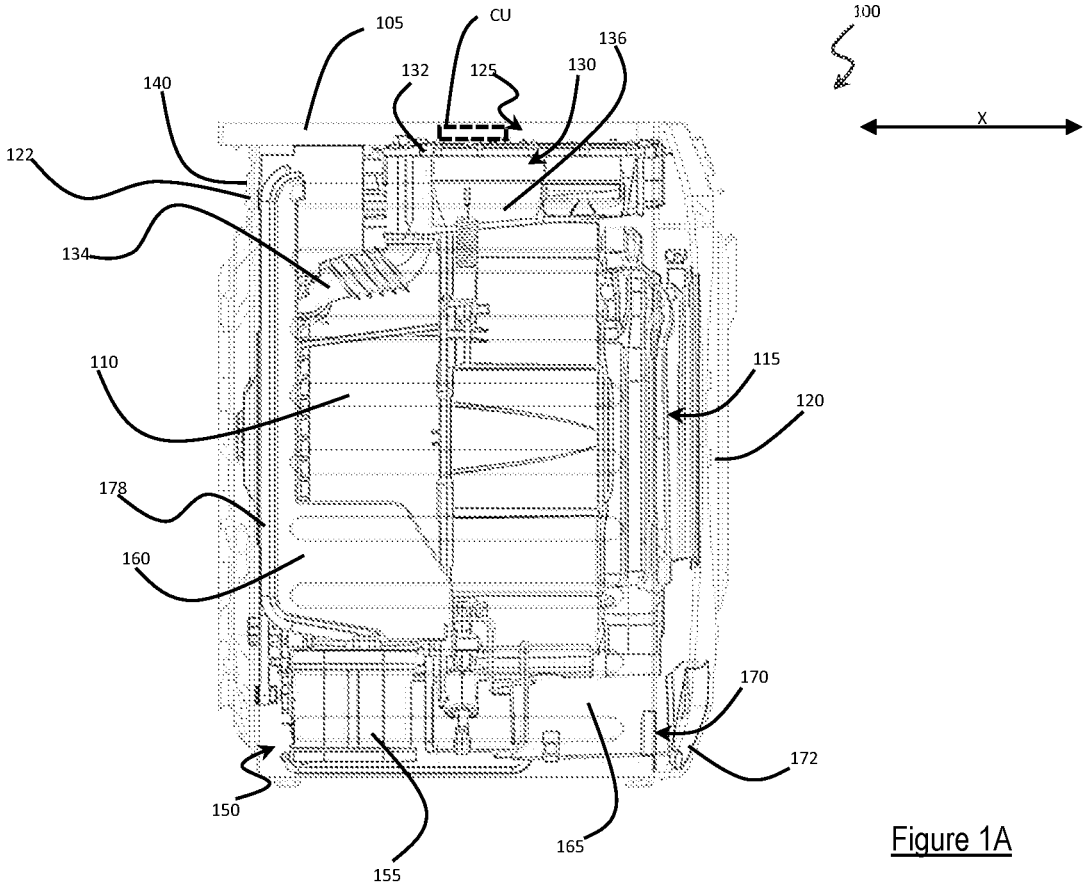
FIG. 1A is a partially transparent side view of a laundry appliance according to an embodiment of the present invention.

With reference to the drawings, FIG. 1A is a partially transparent side view of a laundry appliance 100 according to an embodiment of the present invention.

In the following, when one or more features of the laundry appliance (as well as method steps implemented by it) are introduced by the wording "according to an embodiment", they are to be construed as features additional or alternative to any features previously introduced, unless otherwise indicated and/or unless there is evident incompatibility among feature combinations.

The laundry appliance 100 comprises electric, electronic, mechanical, hydraulic, electromechanical and/or electrohydraulic components and/or systems (hereinafter, concisely, appliance components and/or systems), only the relevant ones deemed relevant for the understanding of embodiments of the present invention being illustrated and discussed in the following for the sake of conciseness.

According to an embodiment, the laundry appliance 100 is a washing machine. In any case, although in the following description explicit reference will be made to a washing machine, this should not to be construed as a limitation; indeed, the present invention equivalently applies to other types of laundry appliances (for example combined washers/dryers, i.e. washing machines also having laundry drying functions).

According to an embodiment, the laundry appliance 100 comprises a control unit CU for controlling the laundry appliance 100 (the control unit CU being schematically illustrated as a dashed rectangle in FIG. 1A).

According to an embodiment, the control unit CU is configured to control (e.g., drive, power, interact with and/or exchange data with) the appliance components and/or systems, in order to manage the execution of selected treatment cycles, as progressively discussed in the following.

The implementation of the control unit CU is not limiting for the present invention.

Just as an example, the control unit CU may comprise a plurality of dedicated electronic sub-units (not shown) each one aimed at controlling one or more respective appliance components and/or systems, and a central electronic unit (not shown) for coordinating the plurality of dedicated control sub-units.

Just as another example, the control unit CU may comprise a single, common electronic unit.

In the following, when one or more of the appliance components and/or systems are said to be operated under the control of the control unit CU, it is meant that these components and/or systems may be equally operated by the respective dedicated electronic units or by the common electronic unit.

According to an embodiment, the control unit CU is configured to control the laundry appliance 100 according to instructions received by a user through a user interface (not shown) of the laundry appliance 100.

According to an embodiment, the user interface may for example comprise a physical user interface (not shown).

According to an embodiment, the user interface may for example comprise a virtual user interface (not shown) provided by a mobile application running on a user device (such as a personal digital assistant (PDA), a smartphone, a tablet, a wearable smart device (such as a smartwatch) or other mobile device, not shown) external to the laundry appliance 100 and communicably coupled thereto (e.g., through a wired or wireless communication link).

According to an embodiment, the laundry appliance 100 comprises a (e.g., parallelepiped-shaped) cabinet 105.

According to an embodiment, the laundry appliance 100 comprises a laundry treatment chamber, such as a washing tub 110. According to an embodiment, the washing tub 110 is accommodated within the cabinet 105.

According to an embodiment, the laundry appliance 100 comprises a (e.g., rotatable) drum, not shown in the figures, adapted to receive laundry to be treated (e.g., to be washed), or laundry load. According to an embodiment, the drum is housed within the washing tub 110.

According to an embodiment, the laundry appliance 100 comprises, e.g. at a cabinet front, a loading opening 115 providing an access to the drum for loading/unloading the laundry load.

According to an embodiment, the laundry appliance 100 comprises a door 120 (shown in a closed position in FIG. 1A) for sealably closing the loading opening 115 during the operation of the laundry appliance 100.

According to an embodiment, the laundry appliance 100 comprises a water supply unit 122 configured to supply fresh water to the laundry appliance 100. According to an embodiment, the water supply unit 122 is located at a cabinet back, preferably at a top portion thereof.

According to an embodiment, the water supply unit 122 comprises a water inlet valve. According to an embodiment, the water inlet valve is connected to a fresh water hose behind the laundry appliance 100 (not shown). According to an embodiment, the fresh water hose is connected to an external water supply (such as the water mains, not shown). According to an embodiment, the water supply unit 122 may be operated in a first operating mode allowing the supply of fresh water to a treatment agent delivery system (discussed in the following), in a second operating mode allowing the supply of fresh water to a water softening system (discussed in the following), or in a third operating mode preventing the supply of fresh water to both the treatment agent delivery system and the water softening system. According to an embodiment, the water supply unit 122 may be operated in the first, second or third operating modes under the control of the control unit CU.

For the purposes of the present disclosure, the fresh water supplied by the water supply unit 122 has a high or relatively high level of hardness (i.e. a high or relatively high amount of dissolved minerals (largely, calcium and magnesium). For the purposes of the present disclosure, the level of hardness of the fresh water is higher than the level of hardness of water (hereinafter, softened water) provided by a water softening system (discussed in the following) from the fresh water.

According to an embodiment, the laundry appliance 100 comprises an apparatus 125 for supplying process liquids into the washing tub 110.

According to an embodiment, the process liquids may comprise water (such as the fresh water or the softened water, as discussed in the following) or a treatment mixture including a treatment agent mixed with water (i.e., a treatment agent mixed with the fresh water or with the softened water).

According to an embodiment, the treatment agent may comprise one or more among a washing detergent, a rinsing detergent, a bleach and a softener.

According to an embodiment, the apparatus 125 comprises a treatment agent delivery system configured to store an amount of treatment agent sufficient for performing a plurality of treatment cycles, and to deliver a treatment agent dose (i.e., a fraction of the stored amount of treatment agent) to be used during an ongoing treatment cycle towards the washing tub 110.

According to an embodiment, determination and delivery of the treatment agent dose are performed by the treatment agent delivery system under the control of the control unit CU.

Thus, the treatment agent delivery system allows the laundry appliance 100 to implement an auto-dosing functionality in which, at each treatment cycle (and when the auto-dosing functionality is enabled), the treatment agent dose is automatically determined, drawn up from the stored amount of treatment agent and delivered to the washing tub 110.

According to an embodiment, the treatment agent delivery system comprises a drawer 130 (discussed in the following).

According to an embodiment, the laundry appliance 100 comprises a drawer seat 136 for housing the drawer 130. According to an embodiment, the drawer 130 is adapted to slide within the drawer seat 136, along a longitudinal or sliding direction X, between an extracted position (not shown) and a retracted position (shown in FIG. 1A). According to an embodiment, the sliding direction X is parallel to a rest surface, such as the floor, on which the laundry appliance 100 rests in operation (i.e., when it is installed in the user premises).

According to an embodiment, the treatment agent delivery system comprises a pumping system 131. As better discussed in the following, under the control of the control unit CU the pumping system 131 is configured to draw up the treatment agent dose from the amount of treatment agent stored in the drawer 130 and to deliver it to the washing tub 110 (e.g., through one or more channels of the drawer, as better discussed in the following).

According to an embodiment, the apparatus 125 comprises a water distribution system 132 for supplying water (e.g., the fresh water or the softened water, as discussed in the following) to the drawer 130 in order to obtain the process liquids. According to an embodiment, the water distribution system 132 comprises a flushing device (not shown) and a controllable valve assembly (not shown) selectively flushing the water towards specific regions of the drawer 130 (such as compartments and/or channels thereof, as discussed here below). According to an embodiment, the controllable valve assembly of the water distribution system 132 is operated under the control of the control unit CU.

According to an embodiment, the flushing device is provided atop the drawer 130, the flushing device for example acting also as a drawer upper cover.

According to an embodiment, the apparatus 125 comprises a process liquid outlet 134 for providing the process liquids to the washing tub 110.

According to an embodiment, the drawer 130 is configured in such a way that the water (i.e., the fresh water or the softened water) from the water distribution system 132 may be:

mixed with one or more treatment agent doses, so that the process liquids provided to the washing tub 110 through the process liquid outlet 134 comprise a corresponding treatment mixture, or not mixed with any treatment agent, so that the process liquids provided to the washing tub 110 through the process water outlet 134 comprise plain water.

According to an embodiment, the process liquids provided to the washing tub 110 through the process liquid outlet 134 may comprise the treatment mixture or the plain water depending on a current phase of a selected (and ongoing) treatment cycle performed by the laundry appliance 100. Just as an example, the process liquids may comprise the treatment mixture during pre-washing and washing phases of the treatment cycle, or the plain water during wetting and rinsing phases of the treatment cycle.

Figure 2:
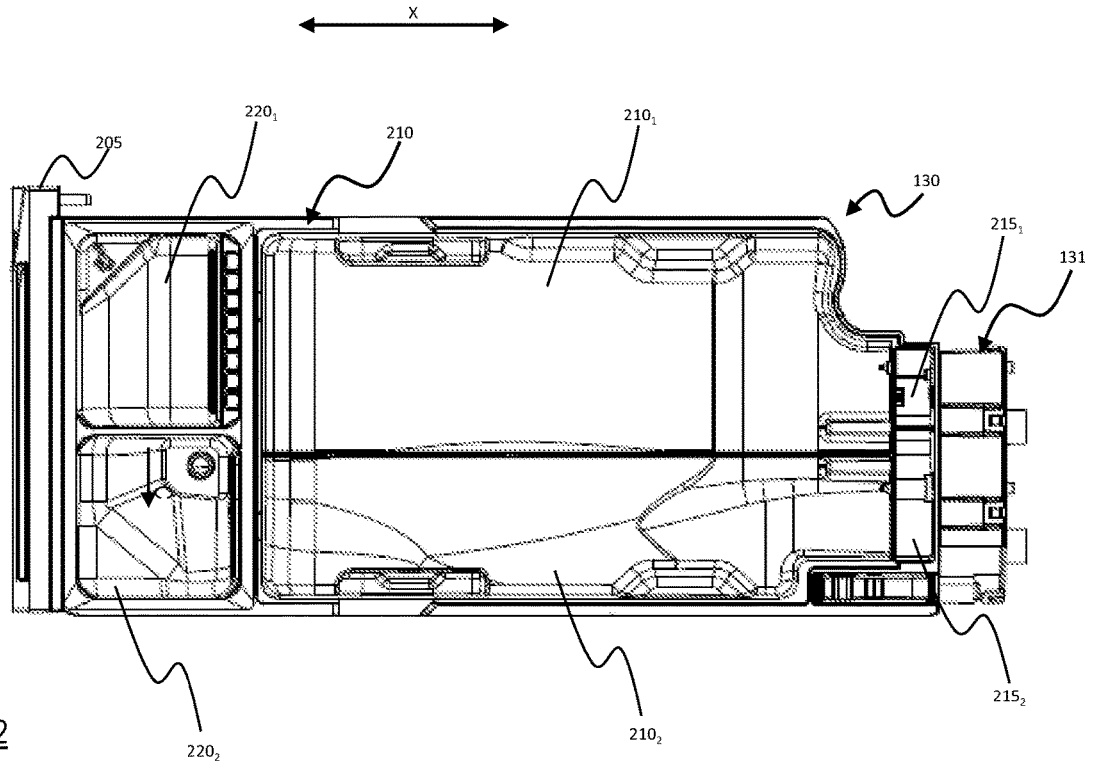
FIG. 2 shows a treatment agent delivery system according to an embodiment of the present invention.

A treatment agent delivery system comprising the drawer 130 and the pumping system 131 according to an embodiment of the present invention is illustrated in FIG. 2.

According to an embodiment, the drawer 130 comprises a drawer handle 205 allowing the user to slidably move the drawer 130 (along the sliding direction X) between the extracted and retracted positions when it is fitted in the drawer seat 136, and a drawer body 210 to which the drawer handle 205 is adapted to be mounted or coupled or connected. According to an embodiment, when the laundry appliance 100 is installed and the drawer 130 is fitted in the drawer seat 136, the drawer handle 205 identifies, along the sliding direction X, a drawer front (which advantageously forms part of the cabinet front when the drawer 130 is in the retracted position).

According to an embodiment, the drawer 130 comprises, behind the handle 205 (taking the sliding direction X as a reference), one or more drawer compartments (hereinafter, multi-dose compartments) adapted to store an amount of one or more treatment agents for performing multiple treatment cycles. In the considered embodiment, two multi-dose compartments $\mathbf{210}_1$,$\mathbf{210}_2$ are provided. In the considered embodiment, each multi-dose compartment $\mathbf{210}_1$,$\mathbf{210}_2$ may be adapted to store an amount of a respective treatment agent for performing multiple treatment cycles. Just as an example, the multi-dose compartment $\mathbf{210}_1$ may be arranged to store an amount of a liquid washing detergent, whereas the multi-dose compartment $\mathbf{210}_2$ may be arranged to contain an amount of a liquid softener.

According to an embodiment, the drawer 130 comprises, behind the multi-dose compartments $\mathbf{210}_1$,$\mathbf{210}_2$ (taking the sliding direction X as a reference), one or more channels for channeling water (from the water distribution system 132) and/or one or more treatment agent doses from the multi-dose compartment(s). In the considered embodiment, two channels $\mathbf{215}_1$,$\mathbf{215}_2$ are provided, which are associated with the multi-dose compartments $\mathbf{210}_1$,$\mathbf{210}_2$ (in the example herein considered, each channel $\mathbf{215}_1$,$\mathbf{215}_2$ is associated with a respective one of the multi-dose compartments $\mathbf{210}_1$,$\mathbf{210}_2$, the channel $\mathbf{215}_1$ being for example associated with the multi-dose compartment $\mathbf{210}_1$ and the channel $\mathbf{215}_2$ being for example associated with the multi-dose compartment $\mathbf{210}_2$).

According to an embodiment, each channel is adapted to channel water (from the water distribution system 132) and one or more treatment agent doses (e.g., from the associated multi-dose compartment) towards a region of the drawer seat 136 (hereinafter referred to as mixing region) that allows a mixture between the water and the treatment agent doses to obtain the treatment mixture as process liquids. According to an embodiment, when process liquids comprising plain water rather than treatment mixture are required, no treatment agent dose is drawn up from the multi-dose compartments, and the water from the water distribution system 132 is channeled unmixed through one or more of the channels.

According to an embodiment, the mixing region may comprise a bottom wall of the drawer seat 136. According to an embodiment, the mixing region opens to the process liquid outlet 134. According to an embodiment, the mixing region is at least partially slanted in order to promote a flow of the process liquids towards the process liquid outlet 134 and, hence, into the washing tub 110.

According to an embodiment, each channel $\mathbf{215}_1$,$\mathbf{215}_2$ is structured and shaped such as to allow the water and the treatment agent doses to fall towards the mixing region of the drawer seat 136 by gravity; in order to achieve it, according to an embodiment, each channel $\mathbf{215}_1$,$\mathbf{215}_2$ comprises a top channel input for receiving the water from the water distribution system 132 above it, and a bottom channel output facing the bottom wall of the drawer seat 136. Having two separate channels $\mathbf{215}_1$,$\mathbf{215}_2$ each one associated with a respective multi-dose compartment $\mathbf{210}_1$,$\mathbf{210}_2$ is advantageous in the embodiment herein considered in which the multi-dose compartments $\mathbf{210}_1$,$\mathbf{210}_2$ store different types of treatment agents (e.g., liquid washing detergent and liquid softener); in fact, in this way, a mixing between the two different types of treatment agents due to the presence of treatment agent residues from channel walls is avoided.

According to an embodiment, the pumping system 131 is arranged behind the channels $\mathbf{215}_1$,$\mathbf{215}_2$ (taking the sliding direction X as a reference). The pumping system 131 may for example be the pumping system disclosed in EP3617379, which is incorporated herein by reference. As disclosed in EP3617379, the pumping system 131 may comprise one or more suction pipes in fluid communication with the multi-dose compartments $\mathbf{210}_1$,$\mathbf{210}_2$ for drawing up the treatment agent doses therefrom, one or more delivery pipes in fluid communication with the channels $\mathbf{215}_1$,$\mathbf{215}_2$ for delivering the treatment agent doses thereto, one or more pumping members for pushing the treatment agent doses from multi-dose compartments $\mathbf{210}_1$,$\mathbf{210}_2$ through the suction and delivery pipes (and, hence, towards the mixing region), and one or more electric motors for operating the pumping members. According to an embodiment, the electric motors (and, hence, the drawing up of the treatment agent doses) are operated under the control of the control unit CU.

The drawing up of the treatment agent dose(s) from the drawer 130 (particularly, from the multi-dose compartment(s) thereof) and the subsequent delivery of the drawn treatment agent dose(s) to the drawer 130 (particularly, to the channel(s) thereof) are conceptually represented in the figure by means of an arc-shaped arrow connection between the pumping system 131 and the drawer 130.

According to an embodiment, the drawer 130 may comprises, in addition to the multi-dose compartments $\mathbf{210}_1$, $\mathbf{210}_2$, one or more (two, in the example at issue) drawer compartments $\mathbf{220}_1$,$\mathbf{220}_2$ each one adapted to contain an amount of a respective treatment agent for performing a single treatment cycle, hereinafter referred to as mono-dose compartments $\mathbf{220}_1$,$\mathbf{220}_2$. Just as an example, the mono-dose compartment $\mathbf{220}_1$ may be arranged to contain a single dose of a powder or liquid washing detergent, whereas the mono-dose compartment $\mathbf{220}_2$ may be arranged to contain a single dose of a powder or liquid or pearl softener. In this embodiment, the water distribution system 132 may be configured to channel water into each selected mono-dose compartment $\mathbf{220}_1$,$\mathbf{220}_2$, where it mixes with the treatment agent contained therein and the resulting treatment mixture is fed towards the process liquid outlet 134.

Back to FIG. 1A, according to an embodiment, the laundry appliance 100 comprises a drain 140 for allowing process liquids contained in the washing tub 110 to be discharged from the laundry appliance 100. According to an embodiment, the drain 140 is located at the cabinet back, preferably at the top portion thereof.

According to an embodiment, the laundry appliance 100 comprises a water softening system 150 configured to receive the fresh water from the water supply unit 122 and to selectively provide the softened water (i.e., water having a level of hardness lower than the level of hardness of the fresh water) to the apparatus 125.

According to an embodiment, the water softening system 150 is configured to receive the fresh water from the water supply unit 122 and to selectively provide the softened water to a treatment agent delivery system provided with multi-dose compartments adapted to store an amount of one or more treatment agents for performing multiple treatment cycles.

Providing the laundry appliance featuring a treatment agent delivery system (for implementing the auto-dosing functionality) with a water softening system avoids, or at least significantly reduces, limestone encrustations that hard or excessively hard water could cause in components or parts of the treatment agent delivery system, thereby prematurely impairing the correct operation of the auto-dosing functionality.

Providing the laundry appliance featuring a treatment agent delivery system (for implementing the auto-dosing functionality) with a water softening system also allows the manufacturer of the laundry appliance to reliably determine an expected lifetime of the treatment agent delivery system (and hence to program in advance maintenance operations) even in the practical scenario of water hardness significantly variable over different geographical areas, over different regions, over different cities or even over different areas of a same cities.

According to an embodiment, the treatment agent delivery system and the water softening system 150 are arranged separate from each other.

By separate arrangement of the treatment agent delivery system and the water softening system it is meant that, contrary to the known solutions of water softening systems integrated to (i.e., formed in a single piece with) drawers including only mono-dose compartments, the treatment agent delivery system and the water softening system 150 are not integrated to each other.

By separate arrangement of the treatment agent delivery system and the water softening system it is also meant that, contrary to the known solutions of water softening systems located in close proximity to (for example, in drawer seats of) drawers including only mono-dose compartments, the treatment agent delivery system and the water softening system 150 are spaced apart from each other, i.e. they are located in different regions of the laundry appliance 100. Just as an example, as better understood from the following discussion of exemplary embodiments, the treatment agent delivery system may be arranged in a first region of the laundry appliance 100 (for example, an upper region of the laundry appliance, or more generally a region of the laundry appliance above the washing tub 100), and the water softening system 150 may be arranged in a second region of the laundry appliance different from the first region (for example, a lower region of the laundry appliance, or, more generally a region of the laundry appliance below or substantially below the washing tub 110).

Since the treatment agent delivery system and the water softening system 150 are separate from each other, the water softening functionality may be effectively applied also to laundry appliances featuring the auto-dosing functionality, which otherwise would be prevented or at least strongly impaired by the large size of the treatment agent delivery systems necessary to implement the auto-dosing functionality (indeed, a water softening system integrated to or formed in close proximity to a treatment agent delivery system having a large size, poses severe constraints on the design of the water softening system).

Just as an example, as better discussed in the following, having the water softening system 150 separated from the treatment agent delivery system (and, preferably, locating the water softening system 150 in a free or available region within the cabinet 105) allows designing the water softening system 150 with increased sizes of its water softening agent container (discussed in the following) and/or of its salt container (discussed in the following), and/or allows further components (such as a water tank configured to store softened water, discussed in the following) to be conveniently added to the water softening system 150.

According to an embodiment, the water softening system 150 is operated under the control of the control unit CU. According to an embodiment, the control unit CU is configured to activate/deactivate the water softening system 150 to, respectively, allow/prevent the supply of the softened water from the water softening system to the treatment agent delivery system (as better discussed in the following).

In the exemplary considered embodiment, the water softening system 150 is configured to provide the softened water to one or more of the channels $\mathbf{215}_1$,$\mathbf{215}_2$ of the drawer 130.

Process liquids comprising softened water allow avoiding the use of high temperatures to treat the laundry load, and strongly reduces laundry load stiffness, premature tear and wear, and skin irritation.

Provision of the softened water to the treatment agent delivery system allows improving an efficiency of the laundry appliance 100, and particularly of the auto-dosing functionality. Indeed, the Applicant has experimentally ascertained that the use of softened water allows reducing the treatment agent dose (i.e., the amount of treatment agent forming the treatment agent dose) necessary to perform the treatment cycle, whereby a higher number of treatment cycles may be performed for the same stored amount of treatment agent.

Selective provision of the softened water to the treatment agent delivery system allows improving an efficiency of the laundry appliance 100, and particularly of the water softening system 150. Indeed, as better discussed in the following, selective provision of the softened water to the treatment agent delivery system allows increasing the number of treatment cycles that may be performed before a maintenance of the water softening system 150 (such as a water softening agent regeneration procedure, as discussed in the following).

As better discussed in the following, selective provision of the softened water to the treatment agent delivery system may be more effectively achieved by a peculiar implementation the water softening system.

However, as better understood from the following discussion of exemplary and not limiting embodiments, the principles of selective provision of the softened water from the water softening system 150 to a treatment agent delivery system realizing the auto-dosing functionality apply regardless of the specific implementation of the water softening system 150. Therefore, although in the following discussion explicit reference will be made to specific and particularly advantageous implementations of the water softening system 150, the principles of the present invention equivalently apply when considering any water softening system, including any water softening system known in the art.

According to an embodiment, the water softening system 150 comprises a water softening agent container 155 configured to store a water softening agent capable of reducing water hardness.

According to an embodiment, the water softening agent comprises an ion-exchange resin.

According to an embodiment, the water softening system 150 comprises a water tank 160 configured to store the softened water. As will be better understood from the following discussion, provision of the water tank 160 allows having a ready-to-use softened water: during the operation of the laundry appliance 100, this ready-to-use softened water allows speeding up the supply of the process liquid to the treatment agent delivery system.

As better discussed in the following, in alternative embodiments no water tank is provided in the water softening system 150: this is conceptually represented in FIG. 1B by a dashed outline of the functional block identifying the water tank 160.

According to an embodiment, the water softening system 150 is configured to supply the softened water (e.g., the softened water contained in the water tank 160, when the water tank 160 is provided in the water softening system 150) to the apparatus 125, in particular to the treatment agent delivery system.

According to an embodiment, the water softening system 150 comprises a salt container 165 configured to store salt. According to an embodiment, the salt stored in the salt container 165 is used for regenerating the water softening agent contained in the water softening agent container 155 during a water softening agent regeneration procedure.

According to an embodiment, the main components of the water softening system 150 are located in a bottom portion of the cabinet 105.

According to an embodiment, the water softening agent container 155 is located in a bottom and rear portion of the volume enclosed by the cabinet 105.

According to an embodiment, the water tank 160 is located (e.g., just) above the water softening agent container 155.

According to an embodiment, the salt container 165 is located at the bottom portion of the cabinet 105, in front of the water softening agent container 155 so that the salt container 165 can be accessed through an opening 170 provided on the cabinet front for allowing the salt container 165 to be refilled with new amounts of salt.

In this way, by exploiting the available space at the bottom and/or rear portions of the cabinet 105, it is advantageously possible to use a water softening agent container 155, a water tank 160 and/or a salt container 165 having a substantially large size, thereby improving the user experience without affecting treatment cycles performance. Particularly, a large size salt container relieves the user from frequent or relatively frequent salt refilling operations, whereas a large size water tank allows having a large or relatively large amount of ready-to-use softened water.

According to an embodiment, a door 172 is advantageously provided on the cabinet front for selectively opening/closing the opening 170.

According to an embodiment, the salt container 165 is configured to be extracted from the cabinet 105 through the opening 170 for allowing an easy refilling of salt.

Figure 1B:
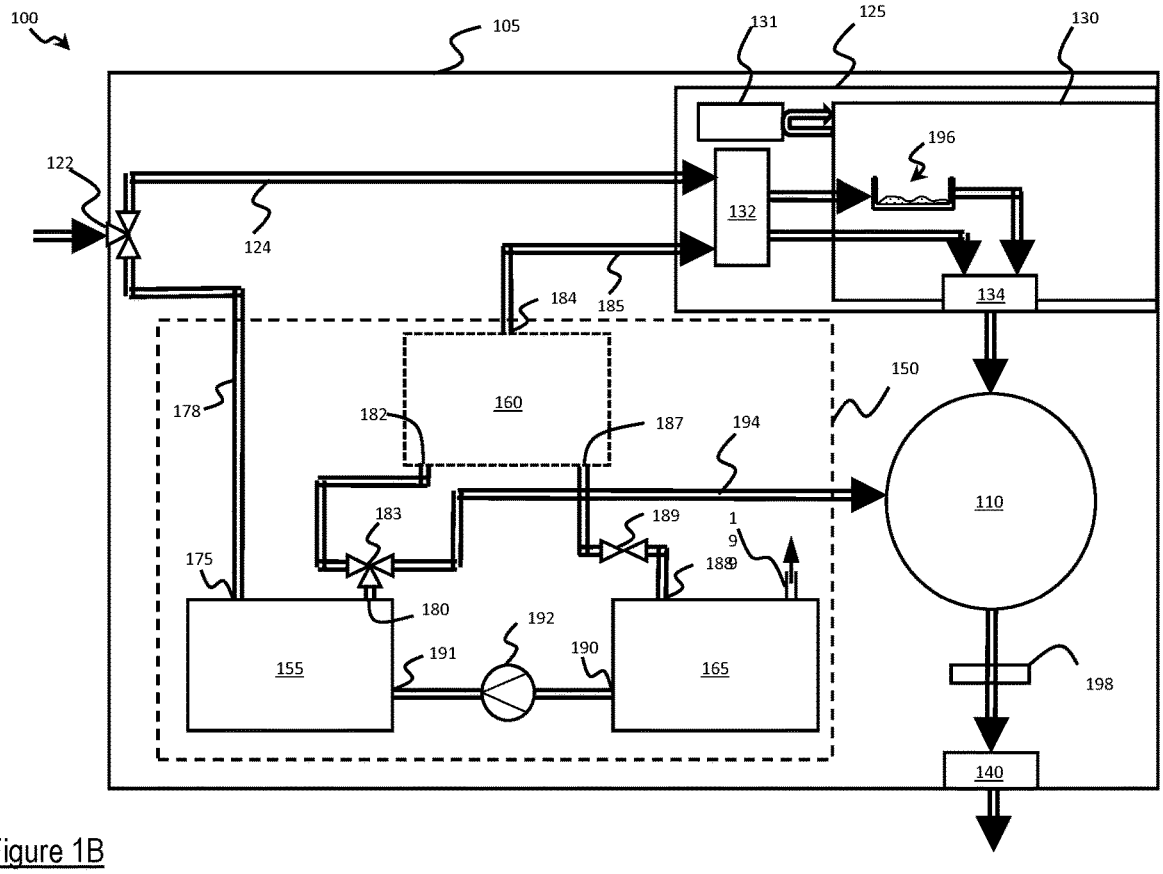
FIG. 1B shows, in terms of simplified functional blocks, a hydraulic circuit of the laundry appliance of FIG. 1A according to an embodiment of the present invention.

With joint reference to FIG. 1B, it shows, in terms of simplified functional blocks, a hydraulic circuit of the laundry appliance 100 according to an embodiment of the present invention.

According to an embodiment, the water softening agent container 155 has a first input 175 fluidly coupled to the water supply unit 122 for receiving the fresh water therefrom. According to an embodiment, the first input 175 of the water softening agent container 155 is fluidly coupled to the water supply unit 122 through a respective duct element 178. For example, the duct element 178 may be a, e.g., rigid, pipe vertically extending from the bottom portion of the volume enclosed by the cabinet 105 where the water softening agent container 155 is located up to the top portion of the cabinet back wherein the water supply unit 122 is located.

According to an embodiment, the first input 175 of the water softening agent container 155 is fluidly coupled to the water supply unit 122 when the water supply unit 122 is operated in the second operating mode.

According to an embodiment, the water supply unit 122 is fluidly coupled to the apparatus 125 (i.e., to the water distribution system 132, and hence to the treatment agent delivery system) when the water supply unit 122 is operated in the first operating mode. According to an embodiment, the water supply unit 122 is fluidly coupled to the apparatus 125 through a respective duct element 124.

According to an embodiment, the water softening agent container 155 has an output 180 for providing the softened water obtained from the received fresh water reacting with the water softening agent.

According to an embodiment, the water tank 160 has an input 182 configured to be selectively in fluid communication with the output 180 of the water softening agent container 155. According to an embodiment, the fluid communication between the output 180 of the water softening agent container 155 and the input 182 of the water tank 160 is selectively enabled by properly operating a water softening agent container valve 183 arranged at the output 180 of the water softening agent container 155, which will be described in greater detail in the following. According to an embodiment, the water softening agent container valve 183 is operated under the control of the control unit CU.

According to an embodiment, the water tank 160 has a first output 184 in fluid communication with the apparatus 125 (i.e., to the water distribution system 132, and hence to the treatment agent delivery system), so that the apparatus 125 can be supplied with softened water contained in the water tank 160. According to an embodiment, the first output 184 of the water tank 160 is fluidly coupled to the apparatus 125 through a duct element 185. According to an embodiment, the duct element 185 may be a, e.g., rigid, pipe vertically extending from the first output 184 of the water tank 160 to the apparatus 125. In the considered example, the duct element 185 extends from the first output 184 of the water tank 160 to the water distribution system 132. As should be understood, in embodiments in which no water tank is provided in the water softening system 150, the duct element 185 may be directly connected to the water softening agent container valve 183 when the water softening agent container valve 183 is in the first operating mode.

According to an embodiment, the salt container 165 is configured to be selectively in fluid communication with the water tank 160 for receiving softened water from the latter. According to an embodiment, a second output 187 of the water tank 160 is configured to be selectively in fluid communication with an input 188 of the salt container 165. According to an embodiment, a water tank valve 189 is provided at the second output 187 of the water tank 160. According to an embodiment, the water tank valve 189 is operated under the control of the control unit CU. According to an embodiment, the water tank valve 189 is configured to be selectively opened during the water softening agent regeneration procedure for selectively causing the second output 187 of the water tank 160 to be in fluid communication with the input 188 of the salt container 165.

As should be understood, in embodiments in which no water tank is provided in the water softening system 150, the salt container 165 may be configured to be selectively in fluid communication with the water supply unit 122 (e.g., through a dedicated duct element, not shown). In these embodiments, the water tank valve 189 may be omitted or provided for other purposes.

According to an embodiment, the salt container 165 comprises an output 190 fluidly connected to a second input 191 of the water softening agent container 155.

According to an embodiment, a pump device 192 is provided for selectively causing liquids coming from the output 190 of the salt container 165 to be pumped into the second input 191 of the water softening agent container 155. According to an embodiment, the pump device 192 is operated between an activated state (causing liquid pumping from the output 190 of the salt container 165 to the second input 191 of the water softening agent container 155) and a deactivated state (preventing liquid pumping from the output 190 of the salt container 165 to the second input 191 of the water softening agent container 155) under the control of the control unit CU.

According to an embodiment, the output 180 of the water softening agent container 155 is configured to be selectively fluidly coupled to the washing tub 110 through a duct element 194. For example, the duct element 194 may be a, e.g., rigid, pipe vertically extending from the output 180 of the water softening agent container 155 to the upper portion of the cabinet 105 and then reaching the washing tub 110.

According to the embodiment, the water tank 160 (when provided) is advantageously formed in a single piece with the duct element 178 and/or the duct element 194. By "formed in a single piece" it is herein intended that the water tank 160 and the duct element(s) 178 and/or 194 are manufactured—e.g., through a single molding step—so as to form a single assembly. By making reference to the exemplary embodiment of the invention illustrated in FIG. 1A, said single assembly provides for having the duct element 194 that is attached to a rear external surface of the water tank 160, and the duct element 178 that is attached to a rear external surface of the duct element 194. Similar considerations apply in case the water tank 160, the duct elements 178 and/or the duct element 194 are attached to each other in a different way.

According to another embodiment (not illustrated), the duct elements 178, 194 and the water tank 160 are not attached to each other to form a single assembly, but instead the duct elements 178, 194 are detached from the water tank 160.

In any case, irrespective of whether or not the duct element 178 and/or the duct element 194 are attached to the water tank 160 to form a single assembly, the fluid connections among these elements and the other elements of the water softening system 150 are arranged as depicted in the hydraulic circuit illustrated in FIG. 2, or according to modification thereof that will be described in the following.

According to an embodiment, the fluid communication between the output 180 of the water softening agent container 155 and the washing tub 110 through the duct element 194 is selectively enabled by properly operating the water softening agent container valve 183 arranged at the output 180 of the water softening agent container 155.

According to an embodiment, the water softening agent container valve 183 is configured to be operated (under the control of the control unit CU) between a first operating mode and a second operating mode.

According to an embodiment, when the water softening agent container valve 183 is in the first operating mode, the output 180 of the water softening agent container 155 is in fluid communication with the input 182 of the water tank 160. According to an embodiment, when the water softening agent container valve 183 is in the first operating mode, fluid communication between the output 180 of the water softening agent container 155 and the washing tub 110 is prevented.

According to an embodiment, when the water softening agent container valve 183 is in the second operating mode, the output 180 of the water softening agent container 155 is in fluid communication with the washing tub 110. According to an embodiment, when the water softening agent container valve 183 is in the second operating mode, fluid communication between the output 180 of the water softening agent container 155 and the input 182 of the water tank 160 is prevented.

According to an embodiment, the water softening agent container valve 183 is configured to be operated in the second operating mode during or after the water softening agent regeneration procedure (so as to discharge a brine-residuals mixture, as discussed in the following).

According to an embodiment, the water softening agent container valve 183 is configured to be operated in a third operating mode in which fluid communication between the output 180 of the water softening agent container 155 and the washing tub 110, and fluid communication between the output 180 of the water softening agent container 155 and the input 182 of the water tank 160 are both prevented.

According to an alternative embodiment, not shown, the water softening agent container 155 may comprise a first output configured to be selectively in fluid communication with the input 182 of the water tank 160 and a second output (different from the first output) configured to be selectively in fluid communication with the washing tub 110.

According to an embodiment, the duct elements 124 and 185 are fluidly coupled to the controllable valve assembly of the water distribution system 132, so that the water distribution system 132 (and, hence, the drawer 130) is selectively fed with the fresh water from the water supply unit 122 (through the duct element 124), or with the softened water from the water tank 160 (through the duct element 185).

The peculiar arrangements of the water softening agent container 155 and of the water tank 160 with respect to each other and with respect to the water supply unit 122 allows reducing the number of components of the laundry appliance 100 that can be in contact with fresh water, thus avoiding or at least strongly reducing formation of limestone on laundry appliance components (such as on the walls of the water tank 160) that can potentially impair the correct operation of the laundry appliance 100.

Moreover, as mentioned above, the peculiar arrangements of the water softening agent container 155 and of the water tank 160 with respect to each other and with respect to the water supply unit 122 and to the treatment agent delivery device allows integration of the water softening system to laundry appliances, such as the laundry appliance 100, featuring auto-dosing functionality.

According to an embodiment, operation of the water softening system 150 may be summarized as follows.

When the supply unit 122 is in the second operating mode, the fresh water from the external water supply is fed to the water softening agent container 155 through the duct element 178 and the first input 175.

The water softening agent contained in the water softening agent container 155 causes a reduction of the hardness of the received fresh water, thus obtaining corresponding softened water.

According to an embodiment, the water softening agent container valve 183 is then switched in the first operating mode, while the softened water tank valve 189 is kept closed and the pump device 192 is kept in the deactivated state, so that the output 180 of the water softening agent container 155 is in fluid communication with the water tank 160. In this condition, the water tank 160 is filled with softened water coming from the water softening agent container 155.

While softened water is provided through the water softening agent container 155, the level of softened water inside the water tank 160 increases and goes up the duct element 185, reaching the apparatus 125. In this condition, the water distribution system 132 (and, hence, the drawer 130) is fed with softened water coming from the water tank 160.

According to an embodiment, as discussed above, the water distribution system 132 is configured to cause the softened water to pass through one or more of the channels $\mathbf{215}_1$,$\mathbf{215}_2$ of the drawer 130, so as to reach the mixing region where, depending on the current treatment cycle phase of the ongoing treatment cycle, it mixes with the treatment agent dose before entering the process liquid outlet 134 or it enters unmixed the process liquid outlet 134—the mixing region being schematically identified in FIG. 1B by reference 196.

In the example herein considered in which the drawer 130 may additionally comprise the mono-dose compartments $\mathbf{220}_1$,$\mathbf{220}_2$, the water distribution system 132 may be configured to selectively cause the softened water to flush into selected one(s) mono-dose compartments, where it mixes with the respective treatment agent contained therein before reaching the mixing region 196 (and, thereafter, the process liquid outlet 134 and the washing tub 100).

When the supply unit 122 is in the first operating mode, the fresh water from the external water supply is fed to the apparatus 125 through the duct element 124: thus, the water distribution system 132 (and, hence, the drawer 130) is fed with the fresh water coming from the supply unit 122.

In this condition, the water softening agent container valve 183 is switched in the third operating mode, the softened water tank valve 189 is kept closed and the pump device 192 is kept in the deactivated state.

According to an embodiment, as discussed above, the water distribution system 132 is configured to cause the fresh water to pass through one or more of the channels $\mathbf{215}_1$,$\mathbf{215}_2$ of the drawer 130, so as to reach the mixing region 196 where, depending on the current treatment cycle phase of the ongoing treatment cycle, it mixes with the treatment agent dose before entering the process liquid outlet 134 or it enters unmixed the process liquid outlet 134.

According to an embodiment, in order to discharge the process liquids contained in the washing tub 110 from the laundry appliance 100, the washing tub 110 is put in fluid communication with the drain 140, for example by activating a proper valve element and/or a proper drain pump (not illustrated in the figures).

According to an embodiment, before reaching the drain 140, process liquids coming from the washing tub 110 are filtered by means of a corresponding drain filter, schematically illustrated in FIG. 1B and denoted by number reference 198.

Therefore:

when the water softening agent container valve 183 is in the first operating mode, the softened water tank valve 189 is closed and the pump device 192 is deactivated, the water softening system 150 is activated (with the supply unit 122 being in the second operating mode), so that softened water is supplied from the water softening system 150 (particularly, from the water tank 160) to the treatment agent delivery system, whereas when the water softening agent container valve 183 is in the third operating mode, the softened water tank valve 189 is closed and the pump device 192 is deactivated, the water softening system 150 is deactivated to prevent the supply of softened water from the water softening system 150 to the treatment agent delivery system.

As mentioned above and better discussed in the following, according to an embodiment activation/deactivation the water softening system 150 may depend on the current phase of the ongoing treatment cycle. Just as an example, the water softening system 150 may be activated in one or more phases of the treatment cycle where process liquids comprising a treatment mixture are required (such as during pre-washing and washing phases), or deactivated in one or more phases of the treatment cycle where process liquids comprising plain water are required (such as during wetting and rinsing phases).

As better discussed in the following, according to an embodiment, activation or deactivation of the water softening system 150 may depend on the treatment cycle selected by the user.

As better discussed in the following, according to an embodiment, activation or deactivation of the water softening system 150 may represent a default setting: just as an example of such a default setting, the control unit CU may be configured to activate (or deactivate) the water softening system 150 when the laundry appliance 100 is switched on. According to an embodiment, such a default setting may result from a corresponding option selected by the user that can be advantageously stored by the laundry appliance 100 until this setting is changed.

According to an embodiment, operation of the water softening system 150 during the water softening agent regeneration procedure may be summarized as follows.

The water tank valve 189 at the second output 187 of the water tank 160 is opened, so that the water stored in the water tank 160 (which, depending on a status of the water softening agent, in this phase could be softened water having a low degree of softening or even non-softened water) is allowed to flow into the salt container 165 through the input 188. The softened water is mixed with salt contained in the salt container 165 so as to generate brine.

According to an embodiment, the salt container 165 is provided with an air vent duct 199 configured to allow air inside the salt container 165 to exit the salt container 165 by a pressure of water coming into the salt container 165 through the input 188. In this way, the salt container 165 can be filled with water in an efficient way, thereby avoiding or at least strongly reducing the formation of undesired air bubbles trapped inside the salt container 165.

According to an embodiment, the brine generated by the salt container 165 is provided to the water softening agent container 155. To this purpose, according to an embodiment, the pump device 192 is operated in the activated state, which causes the brine to be pumped out from the salt container 165 through the output 190 and to be pumped into the water softening agent container 155 through the second input 191 thereof.

The water softening agent contained in the water softening agent container 155 is then regenerated by allowing said water softening agent react with the brine for a predetermined amount of time RT. To this purpose, according to an embodiment, the water softening agent container valve 183 is switched to the third operating mode to prevent fluid communication with the apparatus 125 and the water tank 160, and, after that the water softening agent container 155 is filled with brine, the pump device 192 is temporally operated in the deactivated state during said predetermined amount of time RT.

According to an embodiment, the water softening agent container valve 183 is then switched to the second operating mode to cause the output 180 of the water softening agent container 155 to be in fluid communication with the washing tub 110, then the pump device 192 is operated in the activated state.

In this way, brine mixed with residuals of the water softening agent regeneration (hereinafter, brine-residuals mixture) is pumped through the duct element 194 toward the washing tub 110, and hence discharged through the drain 140.

Since the brine-residuals mixture is prevented from reaching the apparatus 125, no soiling of the apparatus 125 is experienced (which otherwise could impair the subsequent treatment cycles).

In FIG. 1B embodiment, the output 180 of the water softening agent container 155 is in fluid communication with the drain 140, i.e., by skipping the apparatus 125. In this embodiment, the duct element 194 is directly in fluid communication with the washing tub 110.

In alternative embodiments (not illustrated), the duct element 194 may be arranged to be in fluid communication with the drain 140 bypassing the washing tub 110. For example, according to an embodiment, the duct element 194 may be arranged to be directly in fluid communication with the drain 140 or to be in fluid communication with the drain 140 through the filter element 198. In this way, it is avoided that the washing tub 110 gets soiled with residuals of the water softening agent regeneration procedure.

Although preventing the brine-residuals mixture from reaching the apparatus 125 advantageously determines no soiling of the apparatus 125, embodiments are not excluded in which the brine mixed with residuals of the water softening agent regeneration procedure is discharged into the drain 140 through the apparatus 125. In this embodiment, the output 180 of the water softening agent container 155 may be selectively put in fluid communication with the water distribution system 132 of the apparatus 125 for supplying process water. In this way, during a water softening agent regeneration procedure, the water delivery system 132 of the apparatus 125 for supplying process water is supplied with brine mixed with residuals of the water softening agent regeneration, coming from the water softening agent container 155. For example, this embodiment may be allowed when considering the implementation of the drawer 130 discussed above. In this embodiment, the water delivery system 132 may supply the received brine mixed with residuals of the water softening agent regeneration to the channels $\mathbf{215}_1$,$\mathbf{215}_2$ of the drawer 130. Thus, the brine mixed with residuals of the water softening agent regeneration is prevented from reaching the compartments 196 of the drawer 130, and hence the brine mixed with residuals of the water softening agent regeneration procedure water reaches the washing tub 110 (and then, the drain 140) without soiling the compartments 196 of the drawer 130 even if the apparatus 125 is being involved.

Although in the foregoing explicit reference has been exemplary made to specific implementations of the water softening system 150, the principles of the present invention equivalently apply when considering other implementations of the water softening system. In this respect, according to alternative embodiments, not shown in the figures, the water softening system 150 may be any type of water softening system known in the art, for example a water softening system without a water tank configured to store softened water. In these embodiments, such a water softening system may be configured (similarly to the water softening system 150) to receive the fresh water from the water supply unit 122 and to selectively provide the softened water to a treatment agent delivery system provided with multi-dose compartments adapted to store an amount of one or more treatment agents for performing multiple treatment cycles. In other words, in these embodiments, such a water softening system may be configured to receive the fresh water from the water supply unit 122 and to selectively provide the softened water directly (i.e., without interposition of any intermediate components, such as the water tank) to the treatment agent delivery system.

Figure 3:
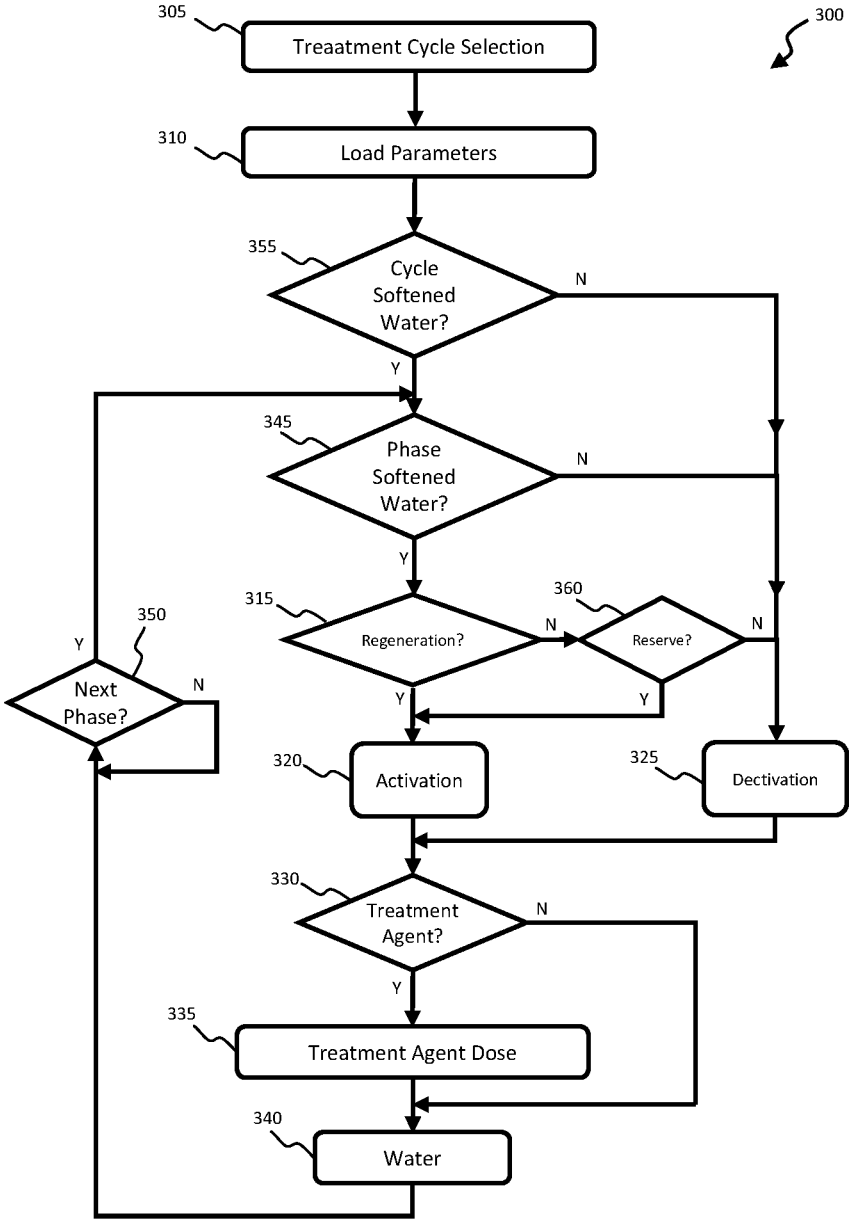
FIG. 3 shows an activity diagram of a procedure according to an embodiment of the present invention.

With reference now to FIG. 3, it shows an activity diagram of a procedure 300 performed by the control unit CU according to an embodiment of the present invention.

Broadly speaking, as better discussed in the following, the control unit CU is configured to operate the water supply unit 122 in the first operating mode when the water softening system 150 is deactivated, so that the treatment agent delivery system delivers to the washing tub 110 a treatment mixture including the treatment agent dose mixed with the fresh water (or the plain fresh water, as the case may be), or operate the water supply unit 122 in the second operating mode when the water softening system 150 is activated, so that the water softening system 150 provides the softened water to the treatment agent delivery system and the treatment agent delivery system delivers to the washing tub 110 a treatment mixture including the treatment agent dose mixed with the softened water (or the plain softened water, as the case may be).

According to an embodiment, upon treatment cycle selection by a user (action node 305), the control unit CU is configured to determine or estimate one or more parameters of the laundry load (hereinafter, laundry parameters) that may directly or indirectly affect the treatment agent dose (i.e., the amount of treatment agent to be used in the selected treatment cycle) (action node 310).

According to an embodiment, the laundry parameters comprise one or more among an amount (e.g., a weight) of the laundry load, a type of the laundry load, and a degree of soiling of the laundry load.

According to an embodiment, the control unit CU is configured to check whether regeneration of the water softening system 150 is required (decision node 315).

According to an embodiment, the control unit CU is configured to activate the water softening system 150 (action node 320) if no regeneration of the water softening system 150 is required (exit branch N of the decision node 315). In embodiments in which the control unit CU is configured to activate the water softening system 150 when the laundry appliance 100 is switched on (e.g., in that the activation of the water softening system 150 when the laundry appliance 100 is switched on represents the default setting), no actions (or, alternatively, actions aimed at ascertaining the actual activation of the water softening system 150) are performed at action node 320.

According to an embodiment, the control unit CU is configured to deactivate the water softening system 150 (action node 325) if regeneration of the water softening system 150 is required (exit branch Y of the decision node 315). In embodiments in which the control unit CU is configured to deactivate the water softening system 150 when the laundry appliance 100 is switched on (e.g., in that the deactivation of the water softening system 150 when the laundry appliance 100 is switched on represents the default setting), no actions (or, alternatively, actions aimed at ascertaining the actual deactivation of the water softening system 150) are performed at action node 325.

According to an embodiment, if the current phase of the selected treatment cycle requires treatment agent (exit branch Y of decision node 330), e.g. in that the current phase of the selected treatment cycle is a pre-washing phase or a washing phase), the treatment agent delivery system is configured to determine and to deliver, under the control of the control unit CU, a treatment agent dose depending on a (activated or deactivated) state of the water softening system 150 (and, hence, depending on the type of (softened or fresh) water forming the treatment mixture) (action node 335).

According to an embodiment, upon determining and releasing the treatment agent dose, the control unit CU is configured to cause the fresh water to enter the laundry appliance 100 from the external water supply (action node 340). According to an embodiment, this is achieved by properly controlling the water supply unit 122 to feed the fresh water into the water softening system 150 (when the water softening system 150 is activated) or into the treatment agent delivery device (when the water softening system 150 is deactivated), so as to obtain process liquids comprising the treatment agent dose mixed with, respectively, the softened water or the fresh water.

According to an embodiment, the treatment agent dose may be determined based on the laundry parameters. Just as an example, the more the amount of the laundry load and/or the degree of soiling of the laundry load, the more the treatment agent dose.

Additionally or alternatively, the treatment agent dose may be determined based on one or more treatment cycle parameters. Just as an example, the shorter the treatment course, the lower the dose of the treatment agent.

Additionally or alternatively, the treatment agent dose may be determined based on one or more treatment agent parameters. Just as an example, the more concentrated, the lower the treatment agent dose.

According to an embodiment, the treatment agent dose determined if the water softening system 150 is activated (i.e., treatment mixture comprising softened water), is different from the treatment agent dose determined if the water softening system 150 is deactivated (i.e., treatment mixture comprising fresh water), e.g. for the same laundry parameters, treatment cycle parameters and treatment agent parameters.

According to an embodiment, the treatment agent dose determined if the water softening system 150 is activated (i.e., treatment mixture comprising softened water), is lower than the treatment agent dose determined if the water softening system 150 is deactivated (i.e., treatment mixture comprising fresh water), e.g. for the same laundry parameters, treatment cycle parameters and treatment agent parameters. Indeed, as mentioned above, the Applicant has experimentally ascertained that the use of softened water allows (for the same laundry parameters, treatment cycle parameters and treatment agent parameters) reducing the treatment agent dose necessary to perform the treatment cycle, without impairing the effectiveness of the treatment cycle.

According to an embodiment, the treatment agent dose may be determined based on the level of hardness of the water. In order to achieve it, according to an embodiment (not shown) the laundry appliance 100 may comprise a water hardness sensing unit for sensing the level of hardness of the fresh water and/or the level of hardness of the softened water.

Just as an example, if the water softening system 150 is activated the treatment agent dose may be determined based on the level of hardness of the resulting softened water. According to an embodiment, the level of hardness of the softened water may be sensed by the water hardness sensing unit, not shown, and/or estimated based on theoretical performance of the water softening system 150 (e.g., possibly taking into account performance degradation over time and/or use). According to an embodiment, the level of hardness of the softened water is adjustable by the water softening system 150 (e.g., under the control of the control unit CU), based on the level of hardness of the fresh water (which may be determined by the water hardness sensing unit, not shown, and/or input by the user through the user interface).

Just as another example, if the water softening system 150 is deactivated the treatment agent dose may be determined based on the level of hardness of the fresh water. According to an embodiment, the level of hardness of the fresh water may be sensed by the water hardness sensing unit, not shown, and/or input by the user through the user interface.

Provision of the water hardness sensing unit and determination (i.e., automatic determination) of the treatment agent dose based on the sensed level of hardness of the water, ensures, over common laundry appliances implementing the auto-dosing functionality, significant advantages both in terms of convenience for the user and in terms of performance and efficiency of the laundry treatment. Indeed, common laundry appliances implementing the auto-dosing functionality need a preliminary manual configuration by the user to correlate the treatment agent dose to the level of hardness of the water, and such a manual configuration has to be carried out by the user by reading the treatment agent characteristics on the treatment agent packaging and by determining the proper treatment agent dose with regard to the level of hardness of the water: however, such a manual configuration is usually avoided by the user due to its complexity or just because the user generally does not know the value of hardness of the water, so that typically predefined standard values of treatment agent dose are used by the laundry appliance without considering the real level of hardness of the water. Consequently, in common laundry appliances implementing the auto-dosing functionality the treatment agent dose may comprise an inadequate amount of treatment agent, so that the result of the laundry treatment may be not satisfactory (laundry treated by using excessively hard water may become stiff, subjected to premature tear and wear, and cause skin irritation), or the treatment agent dose may comprise an unnecessary high amount of treatment agent, which results in environmental pollution.

Back to decision node 330, if the current phase of the selected treatment cycle does not require treatment agent (exit branch N of decision node 330), e.g. in that the current phase of the selected treatment cycle is a wetting phase or a rinsing phase, the fresh water is caused to enter the laundry appliance 100 from the external water supply as discussed above (action node 340), so as to obtain process liquids comprising the plain softened water (when the water softening system 150 is activated) or the plain fresh water (when the water softening system 150 is deactivated).

According to an embodiment, as mentioned above, the control unit CU may be configured to activate the water softening system 150 on the basis of the current phase of the selected (and ongoing) treatment cycle. To this purpose, according to an embodiment, the control unit CU may be configured to determine if the current phase of the selected treatment cycle requires softened water (decision node 345). According to an embodiment, decision node 345 is performed before decision node 315, although this should not be construed limitatively.

According to an embodiment, if the current phase of the selected treatment cycle does not require softened water (exit branch N of the decision node 345), the control unit CU is configured to deactivate the water softening system 150 (action node 325). As discussed above, in embodiments in which the control unit CU is configured to deactivate the water softening system 150 when the laundry appliance 100 is switched on (e.g., in that the deactivation of the water softening system 150 when the laundry appliance 100 is switched on represents the default setting), no actions (or, alternatively, actions aimed at ascertaining the actual deactivation of the water softening system 150) are performed at action node 325.

According to an embodiment, if the current phase of the selected treatment cycle requires softened water (exit branch Y of the decision node 345), nodes 315 to 340 are performed as such as discussed above.

According to an embodiment, nodes 315 to 340 and node 345 are iterated for each phase of the selected treatment cycle. This is conceptually illustrated in the figure by loop connection between action nodes 340 and 345, with interposition of a decision node 350 aimed at determining whether the following phase of the ongoing treatment cycle has begun or is about to begin: if the following phase of the ongoing treatment cycle has begun or is about to begin (exit branch Y of the decision node 350), nodes 315 to 340 are repeated as such for the following phase (which becomes the new current phase), otherwise (exit branch N of the decision node 350), the end of the current phase is waited (as conceptually illustrated in the figure by loop connection between the exit branch N of the decision node 350 and the input branch thereof).

As mentioned above, according to an embodiment, the control unit CU may be configured to activate the water softening system 150 on the basis of the treatment cycle selected by the user. To this purpose, according to an embodiment, the control unit CU may be configured to determine, e.g. after selection of the treatment cycle by the user, if the selected treatment cycle requires softened water (decision node 355). Examples of treatment cycles that do not (necessarily) require softener water comprise, but are not limited to, economic treatment cycles conceived for reducing energy and water consumption, and quick treatment cycles intended to treat lightly soiled and unspotted clothes in a short time.

According to an embodiment, if the selected treatment cycle does not require softened water (exit branch N of the decision node 345), the control unit CU is configured to deactivate the water softening system 150 (action node 325). As discussed above, in embodiments in which the control unit CU is configured to deactivate the water softening system 150 when the laundry appliance 100 is switched on (e.g., in that the deactivation of the water softening system 150 when the laundry appliance 100 is switched on represents the default setting), no actions (or, alternatively, actions aimed at ascertaining the actual deactivation of the water softening system 150) are performed at action node 325.

According to an embodiment, if the selected treatment cycle requires softened water (exit branch Y of the decision node 355), nodes 315 to 340 (and, possibly, nodes 345 and 350, when provided) are performed as such as discussed above.

As mentioned above, selective provision of the softened water to the treatment agent delivery system based on the selected treatment cycle and/or on the current phase of the ongoing treatment cycle allows improving an efficiency of the laundry appliance 100, in that it allows increasing the number of treatment cycles that may be performed before a maintenance of the water softening system 150 (such as the water softening agent regeneration procedure).

According to an embodiment, the control unit CU may be configured to activate the water softening system 150 based on an availability of a reserve of softened water being stored in the water softening system (particularly, in the water softening agent container 155 and/or in the in the water tank 160). According to an embodiment, the reserve of softened water may comprise softened water resulting from a previous treatment cycle or from a previous phase of the ongoing treatment cycle, the reserve of softened water for example representing unused softened water of a previous treatment cycle.

According to an embodiment, if no regeneration of the water softening system 150 is required (exit branch N of the decision node 315), the control unit CU may be configured to check the availability of a reserve of softened water being stored in the water softening system 150 (decision node 360).

According to an embodiment, if a reserve of softened water is stored in the water softening system 150 (exit branch Y of the decision node 360), the control unit CU may be configured to activate the water softening system 150 (action node 320). As should be understood, in this embodiment, the reserve of softened water could be lower than the amount of water necessary to perform the current phase of the ongoing treatment cycle. However, although the remaining water (which is expected to exhibit a level of hardness higher than that of the reserve of softened water, in that the required regeneration of the water softening system 150 has not taken place so far) is non-ideal softened water, the presence of the reserve of softened water (which is ideal or almost ideal softened water) may in any case be sufficient to ensure the above-discussed benefits of using softened water. According to an embodiment, not shown, decision node 360 is performed only at a first running of the exit branch N of the decision node 315, i.e. only after the first time the missing regeneration of the water softening system 150 is ascertained: indeed, after such a first running, any subsequent reserve of water stored in the water tank 160 without that the regeneration of the water softening system 150 has taken place, is non-ideal softened water.

According to an embodiment, if no reserve of softened water is stored in the water softening system 150 (exit branch N of the decision node 360), the control unit CU may be configured to deactivate the water softening system 150 (action node 325).

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry treatment appliance comprising:

a laundry treatment chamber;

a treatment agent delivery system comprising storage for an amount of treatment agent sufficient for performing a plurality of treatment cycles, and to deliver a treatment agent dose towards the laundry treatment chamber, the treatment agent dose being a fraction of the stored amount of treatment agent;

a water supply unit for supplying fresh water having a first level of hardness;

a water softening system coupled to the water supply unit and to the treatment agent delivery system, wherein the water softening system supplies softened water having a second level of hardness lower than the first level of hardness to the treatment agent delivery system;

a water hardness sensing unit operably coupled to both the water supply unit and the water softening system for sensing one or both of the first level of hardness or the second level of hardness; and a control unit operably coupled to the water supply unit and the water softening system, wherein the control unit is configured to determine the treatment agent dose based on the first level of hardness or the second level of hardness.

2. The laundry treatment appliance according to claim 1, wherein the treatment agent delivery system and the water softening system are arranged separate from each other.

3. The laundry treatment appliance according to claim 1, wherein the control unit is configured to activate/deactivate the water softening system to, respectively, allow/prevent the supply of the softened water from the water softening system to the treatment agent delivery system.

4. The laundry treatment appliance according to claim 3, wherein, during an ongoing treatment cycle, the control unit is configured to activate/deactivate the water softening system depending on a current phase of the ongoing treatment cycle.

5. The laundry treatment appliance according to claim 3, wherein the control unit is configured to activate the water softening system when the laundry treatment appliance is switched on.

6. The laundry treatment appliance according to claim 3, wherein the control unit is configured to activate the water softening system if no regeneration of the water softening system is required, and to deactivate the water softening system if regeneration of the water softening system is required.

7. The laundry treatment appliance according to claim 3, wherein the control unit is configured to operate the water supply unit in a first or second operating mode allowing the supply of the fresh water from the water supply unit to the treatment agent delivery system or to the water softening system, respectively, the control unit being configured to:

operate the water supply unit in the first operating mode when the water softening system is deactivated, so that the treatment agent delivery system delivers to the laundry treatment chamber a treatment mixture including the treatment agent dose mixed with the fresh water, or operate the water supply unit in the second operating mode when the water softening system is activated, so that the water softening system provides the softened water to the treatment agent delivery system and the treatment agent delivery system delivers to the laundry treatment chamber a treatment mixture including the treatment agent dose mixed with the softened water.

8. The laundry treatment appliance according to claim 7, wherein the control unit is configured to determine the treatment agent dose based on the first level of hardness when the water supply unit is operated in the first operating mode and to determine the treatment agent dose based on the second level of hardness when the water supply unit is operated in the second operating mode.

9. The laundry treatment appliance according to claim 3, wherein the control unit is configured to activate the water softening system on the basis of a treatment cycle selected by the user.

10. The laundry treatment appliance according to claim 3, wherein the water softening system comprises a water tank, wherein the water tank of the water softening system is configured to store unused softened water resulting from a previous treatment cycle, the control unit being configured to activate the water softening system based on an availability of the unused softened water being stored in the water softening system.

11. The laundry treatment appliance according to claim 3, wherein the control unit is configured to determine a first treatment agent dose if the water softening system is activated, or a second treatment agent dose different from the first treatment agent dose if the water softening system is deactivated, the first treatment agent dose being lower than the second treatment agent dose.

12. The laundry treatment appliance according to claim 11, wherein the control unit is configured to determine the first treatment agent dose based on at least one among:

the second level of hardness;

one or more laundry parameters among an amount of the laundry load, a type of the laundry load, and a degree of soiling of the laundry load;

one or more treatment cycle parameters; and one or more treatment agent parameters.

13. The laundry treatment appliance according to claim 1, wherein the water softening system comprises a water tank configured to store the softened water, the water softening system being configured to supply the softened water contained in said water tank to said treatment agent delivery system.

14. The laundry treatment appliance according to claim 13, wherein the water tank of the water softening system is configured to store unused softened water resulting from a previous treatment cycle, the control unit being configured to activate the water softening system based on an availability of the unused softened water being stored in the water softening system.

15. The laundry treatment appliance according to claim 13, wherein the control unit is configured to determine a first treatment agent dose if the water softening system is activated, or a second treatment agent dose different from the first treatment agent dose if the water softening system is deactivated, the first treatment agent dose being lower than the second treatment agent dose.

16. The laundry treatment appliance according to claim 15, wherein the control unit is configured to determine the first treatment agent dose based on at least one among:

the second level of hardness;

one or more laundry parameters among an amount of the laundry load, a type of the laundry load, and a degree of soiling of the laundry load;

one or more treatment cycle parameters; and one or more treatment agent parameters.

17. The laundry treatment appliance according to claim 1, further comprising a water hardness sensing unit for sensing the first level of hardness, the water softening system being configured to adjust the second level of hardness based on the sensed first level of hardness.

18. The laundry treatment appliance according to claim 1, wherein the water hardness sensing unit is configured to sense the first level of hardness and the control unit is configured to adjust the second level of hardness based on the first level of hardness.

19. The laundry treatment appliance according to claim 1, further comprising an interface, wherein the first level of hardness is input into the control unit through the user interface, and the control unit is configured to determine the treatment agent dose based on the input first level of hardness.

20. A laundry treatment appliance comprising:

a laundry treatment chamber;

a treatment agent delivery system comprising storage for an amount of treatment agent sufficient for performing a plurality of treatment cycles, and to deliver a treatment agent dose towards the laundry treatment chamber, the treatment agent dose being a fraction of the stored amount of treatment agent;

a water supply unit;

a water softening system coupled to the water supply unit and treatment agent delivery system, wherein the water softening system supplies softened water to the treatment agent delivery system;

a water hardness sensing unit operably coupled to the water softening system for sensing a level of hardness of the softened water; and a control unit operably coupled to the water supply unit and the water softening system, wherein the control unit is configured to determine the treatment agent dose based on the level of hardness of the softened water.

21. The laundry treatment appliance according to claim 20, wherein the control unit is configured to estimate the level of hardness based on the performance of the water softening system, and to determine the treatment agent dose based on the estimated level of hardness.

22. The laundry treatment appliance according to claim 20, wherein the control unit is configured to estimate the level of hardness based on the previous usage of the water softening system and/or the performance degradation of the water softening system over time.

* * * * *